US010738447B2

(12) United States Patent
Muirhead

(10) Patent No.: US 10,738,447 B2
(45) Date of Patent: Aug. 11, 2020

(54) WASTE FITTING

(71) Applicant: Philip John Muirhead, Mount Molloy (AU)

(72) Inventor: Philip John Muirhead, Mount Molloy (AU)

(73) Assignee: KELLOPHIE IP HOLDINGS PTY LTD, Mount Molloy, Queensland (AU)

( * ) Notice: Subject to any disclaimer, the term of this patent is extended or adjusted under 35 U.S.C. 154(b) by 0 days.

(21) Appl. No.: 15/991,542

(22) Filed: May 29, 2018

(65) Prior Publication Data

US 2018/0274217 A1 Sep. 27, 2018

Related U.S. Application Data

(63) Continuation of application No. 13/812,493, filed as application No. PCT/AU2011/000932 on Jul. 27, 2011, now Pat. No. 9,988,800.

(30) Foreign Application Priority Data

Jul. 28, 2010 (AU) ..... 2010903364

(51) Int. Cl.
*E03C 1/20* (2006.01)
*A47K 3/40* (2006.01)
*E03F 5/04* (2006.01)

(52) U.S. Cl.
CPC ..... *E03C 1/20* (2013.01); *A47K 3/40* (2013.01); *E03F 5/0408* (2013.01); *Y10T 29/4978* (2015.01)

(58) Field of Classification Search
CPC .... E03C 1/20; E03C 1/12; A47K 3/40; A47K 3/405; A47K 3/28; E03F 5/0408
(Continued)

(56) References Cited

U.S. PATENT DOCUMENTS 2,484,240 A * 10/1949 Morthland ..... A47K 3/40 4/613
3,744,065 A 7/1973 Yavitch
(Continued)

FOREIGN PATENT DOCUMENTS

CN 1755019 A 4/2006
DE 102004049130 A1 4/2006
(Continued)

OTHER PUBLICATIONS

International Search Report and Written Opinion in corresponding PCT application No. PCT/AU2011/000932, dated Nov. 3, 2011, 10 pp.
(Continued)

*Primary Examiner* — Huyen D Le
(74) *Attorney, Agent, or Firm* — Tredecim LLC; Sean L. Sweeney; Taylor A. Noonan

(57) ABSTRACT

The invention relates to a waste fitting including a waste pan means into which waste can flow, at least one part of the waste pan means allowing visual inspection therethrough. During installation, an opening of the waste outlet can be located by visual inspection through the or each at least one part of the waste pan means, enabling a suitable position to be determined for forming and or positioning of at least one aperture in the waste pan means. The at least on aperture is formed such that, in use, waste that flows into the waste pan means can exit through the or each at least one aperture towards the opening in the waste outlet. The invention also relates to a method of installing a waste fitting.

11 Claims, 12 Drawing Sheets

(58) Field of Classification Search
USPC ..... 4/695, 679
See application file for complete search history.

(56) References Cited

U.S. PATENT DOCUMENTS

| | | | | |
|---|---|---|---|---|
| 4,984,309 | A | 1/1991 | Lowry | |
| 5,022,430 | A | 6/1991 | Degooyer | |
| 6,886,190 | B2 | 5/2005 | Tompane | |
| 7,472,719 | B2 * | 1/2009 | Dallmer | E03F 5/0408 137/362 |
| 7,784,242 | B2 * | 8/2010 | Warnecke | E04D 13/0409 210/163 |
| 7,964,095 | B1 | 6/2011 | Graybeal | |
| 8,486,260 | B2 * | 7/2013 | Tripodi | E03F 5/0407 210/164 |
| 9,175,464 | B2 * | 11/2015 | Meyers | E03F 5/0408 |
| 9,988,800 | B2 * | 6/2018 | Muirhead | A47K 3/40 |
| 2011/0203048 | A1 * | 8/2011 | Fima | E03C 1/281 4/679 |

FOREIGN PATENT DOCUMENTS

| | | | |
|---|---|---|---|
| EP | 2206456 | A2 | 7/2010 |
| EP | 2227997 | A1 | 9/2010 |
| JP | 2002088839 | | 3/2002 |
| JP | 2002088839 | A1 | 3/2002 |
| JP | 2002219063 | A1 | 8/2002 |
| JP | 2008025106 | A1 | 2/2008 |
| JP | 2008115577 | A1 | 5/2008 |
| NZ | 299981 | B2 | 8/1997 |

OTHER PUBLICATIONS

First Examination Report in corresponding New Zealand application No. 606323, dated Aug. 28, 2013, 4 pp.
Supplemental European Search Report in corresponding European application No. EP11811635, dated Nov. 21, 2016, 8 pp.
Examination Report in corresponding Chinese application No. 201180036497.7, dated Dec. 4, 2013, 13 pp. (no translation available).
Best available translation of item CN1755019A, Apr. 5, 2006, to 株式会社技术工业, 10 pp. (translation via Google Patents).
English Abstract of item EP2227997A1, Sep. 15, 2010, to Illbruck Sanitaertechnik GMBH, 2 pp. (via Espacenet).
Best available translation of item DE102004049130A1, Apr. 13, 2006, to Artweger GMBH Co., Bad Ischi, AT, 5 pp. (translation via Google Patents).
Best available translation of item JP 200288839, Mar. 27, 2002, to Toto LTD, 8 pp. (machine translation powered by EPO and Google).

* cited by examiner

WASTE FITTING

CROSS-REFERENCE TO RELATED APPLICATIONS

This application is a continuation of U.S. application Ser. No. 13/812,493, which is the National Stage of International application Ser. No. PCT/AU2011/000932, filed Jul. 27, 2011, which claims priority to Australian Application No. 1010903364, filed on Jul. 28, 2010, the disclosures of which are herein incorporated by reference.

FIELD OF THE INVENTION

The present invention relates to a waste fitting, and in particular to a waste fitting for a shower, bath, spa or the like.

BACKGROUND OF THE INVENTION

The following describes a non-limiting example of the invention being used as a waste fitting for a shower or bath waste outlet; it is envisaged that there are numerous other applications of the invention.

Plumbing a new or replacement shower, for example, is a tricky business. Skill and planning are required to ensure the proper alignment of the various parts so that the shower is fitted correctly. In particular, it is important to align the waste fitting that captures the waste water from the shower, with the outlet pipe in the floor.

Part of the difficulty when plumbing a shower, is the fixed position of the outlet pipe. When plumbing a waste fitting to an outlet pipe the waste fitting and the outlet pipe must be aligned, preferably perfectly. It is desirable, if possible, to have the waste flow directly down into the outlet pipe. Significant misalignment between the waste fitting and the outlet pipe can lead to the requirement of plumbdingers, an adjustable pipe or the like, that fills the gap due to the misalignment of the waste fitting and the outlet pipe. The flow of the waste may be slower if plumbdingers or the like are used, creating a risk of accumulation of scum or debris. Use of plumbdingers or the like, or working to fix up a misaligned waste fitting and outlet pipe increases the time and, inevitably, the cost of the plumbing job. Even a slight misalignment between the waste fitting and the outlet pipe is also highly undesirable. The seal may need to be improved with plumber's tape or sealant and the finished job will be of a lower quality and visually unattractive, compared to an accurate and precisely fitted waste fitting.

A problem with aligning a waste fitting with an outlet pipe, when fitting a shower, for example, is that once the shower base is in place, it is very difficult to see the position of the outlet pipe below. Careful measuring and marking must be undertaken, before the shower base is put in place, to try to align the position of the outlet pipe with that of the waste fitting. Further, the person plumbing the shower will need to work under the shower base to fit together the outlet pipe with the waste fitting which is awkward and difficult. Working upside down makes fitting the waste fitting straight and perfectly aligned with the outlet pipe a real challenge.

It is highly desirable to have an improved waste fitting or method of installation of a waste fitting which can be more readily aligned with the outlet pipe. It is also highly desirable to have a waste fitting or method of installation of a waste fitting which can be installed without the need to work under the shower base, or similar, once the shower base, or similar, is in place.

For clarity, any prior art referred to herein, does not constitute an admission that the prior art forms part of the common general knowledge in Australia, or elsewhere.

It is an object of the present invention to provide a waste fitting that at least ameliorates one or more of the aforementioned problems of the prior art.

DISCLOSURE OF THE INVENTION

Accordingly, the present invention provides a waste fitting for a waste outlet, the waste fitting including a waste pan means into which waste can flow, at least one part of the waste pan means allowing visual inspection therethrough, wherein, during installation, an opening of the waste outlet can be located by visual inspection through the or each at least one part of the waste pan means, enabling a suitable position to be determined for forming and or positioning of at least one aperture in the waste pan means such that, in use, waste that flows into the waste pan means can exit through the or each at least one aperture towards the opening in the waste outlet.

Where an adaptor is used on the waste outlet the visual inspection through the waste pan can locate the waste outlet through an adaptor or connecting means or locate the adaptor or connecting means itself. In another form of the invention, visual inspection may occur through any suitable part of the waste fitting, rather than the waste pan, such that a suitable position for forming and or positioning of at least one aperture in the waste pan means can be ascertained so that, in use, waste that flows into the waste pan means can exit through the or each at least one aperture toward the opening in the waste outlet. Preferably, the suitable position is a position where the or each at least one aperture is substantially aligned with the opening of the waste outlet. Preferably, the suitable position aligns the or each at least one aperture with the opening of the waste outlet so waste will flow directly from the or each at least one aperture into the opening of the waste outlet. Preferably, the or each at least one aperture in the waste pan means is formed after visual inspection through the or each at least one part of the waste pan means and alignment with the opening in the waste outlet. In an alternative form of the invention the or each at least one aperture in the waste pan means is formed before installation and visual inspection enables the positioning of the or each at least one aperture substantially in alignment with the opening of the waste outlet. Therefore the waste pan can be put in position and at least one aperture made in the correct alignment, or if at least one aperture has already been formed rotation of the waste pan can be made until the at least on aperture is aligned with the waste outlet.

Preferably, the waste will flow substantially directly from the or each at least one aperture in the waste pan means to the opening of the waste outlet. In an alternative form of the invention the waste flows from the or each at least one aperture in the waste pan means through one or more intermediary parts, stages, or a conduit before flowing into the opening of the waste outlet.

The present invention also provides a method of installing a waste fitting for a waste outlet, the method including the steps of:

a) positioning a waste pan means of the waste fitting generally above a waste outlet, at least one part of the waste pan means allowing visual inspection therethrough;
b) identifying and marking a position or positions on the waste pan means by visual inspection therethrough for at least one aperture so the or each at least one aperture will be substantially aligned with an opening in the waste outlet below;

c) forming the or each at least one aperture in the waste pan means in the position or positions; and d) connecting the waste outlet to the waste pan means so that the waste can flow through the or each at least one aperture into the opening of the waste outlet.

The method may also include the additional steps of:

e) marking and or measuring the position of the opening of the waste outlet for a shower, bath, spa or the like; and f) positioning a recess of the shower, bath, spa or the like according to the marked and or measured position of the opening of the waste outlet.

The method may also include the additional step of:

g) forming one or more pilot holes in the waste pan means in situ, removing the waste pan means in order that the or each pilot hole be expanded to the desired dimensions.

The method may also include the additional step of:

h) forming holes in the waste pan means for receipt of screws to attach a connecting means to the waste outlet.

The method may also include the additional step of:

i) attaching and or sealing the connecting means to the waste outlet and or waste pan means, by glue, silicone or the like.

Preferably, the connecting means substantially surrounds the or each at least one aperture in the waste pan means and the connecting means is a conduit for waste between the waste pan means and the opening of the waste outlet.

With reference to the waste fitting and method of installation of a waste fitting, the waste fitting may include a shower base, bath, spa or similar adapted to receive the waste pan. Preferably, the waste fitting including a shower base, bath, spa or similar is sold as a unit.

The waste fitting may be made of any suitable material or combination of materials. Preferably, the waste fitting is made of plastics material.

The waste outlet may be any waste outlet for use to direct waste away. The waste outlet may be in a building or alternatively, outside. Preferably, the waste outlet is cut level with the ground or a floor before installation of the waste fitting. Typically, the waste outlet may be a plastic pipe which projects out of a floor in a bathroom, for example. The waste outlet may be exposed, in particular, during construction of a new home or if renovations are undertaken and the existing bathroom fittings are removed.

The opening of the waste outlet may be a round hole. The opening of the waste outlet may take any suitable shape or form. The waste outlet may be the waste outlet for use for a shower, bath, spa or the like. Preferably, the waste fitting includes or is used with a shower base, bath, spa or the like, the shower base, bath, spa or the like including a recess and it is into this recess that waste may flow. Preferably, a fall or slope of the shower, bath, spa or the like directs flow of waste towards the recess. Preferably, the recess includes a floor and one or more walls. The recess may be formed in the shower, bath, spa or the like such that the wall of the recess is continuous with the floor of the shower, bath, spa or the like. A floor of the recess may be formed by a concrete or timber floor below the shower, bath, spa or the like.

The recess may be any suitable shape or dimensions. Preferably, the one or more walls of the recess include one or more lips or projections. The lips or projections may take any suitable form. There may be a single lip or projection. There may be a plurality of lips or projections. The recess may be any suitable shape in cross-section including rectangular including square, circular, diamond or hexagonal, or irregular shaped, for example. Preferably, the recess in cross-section is substantially the same shape as the profile from above of the waste pan means. Most preferably, the recess is square in cross-section. Alternatively, the recess is preferably, circular in cross-section.

Preferably, the waste pan means is adapted to substantially fit in the recess. Preferably, the waste pan means is configured so as to fit closely within the recess. Most preferably, where the recess is square in cross-section the waste pan is also square in profile from above. Preferably, where the recess is circular in cross-section the waste pan is also circular in profile from above. Preferably, the waste pan is a flat square of material. Alternatively, the waste pan may be a circular disc. The waste pan means may be made of any suitable material. Preferably, the waste pan means is made of plastic.

Preferably, the waste pan has a flat edge. The waste pan means may, in an alternative form of the invention, include an angled edge to facilitate the removal of the waste pan means from the recess during installation. The angle of the edge may be any suitable angle. The angle may be substantially 30 degrees from the horizontal. In another form of the invention the waste pan means may be a round or square based dish having a floor and one or more walls.

Preferably, the waste pan means is adapted to lie on the one or more lips or projections of the recess. The waste pan may rest or be attached to one or more of the lips or projections. Preferably, the waste pan is attached to the one or more lips by glue, silicone or the like. In one form of the invention the angle of the edge of the waste pan means facilitates and or strengthens the bonding of the edge by the glue, silicone or the like to the one or more lips or projections. The waste pan may be attached by screws to the lips or projections. Screws may be used, for example at each of the four corners of a square waste pan to secure the installed waste pan to a shower base, bath, spa or the like.

Waste may be any waste that will flow to a waste outlet including grey water, such as from a shower, bath, spa or the like. Waste may be clean water. Waste may be any material that flows.

The or each at least one part of the waste pan means that allows visual inspection therethrough may take any suitable form. Preferably, the waste pan means includes at least one transparent part. Preferably, the waste pan means includes at least one clear plastic part. Most preferably, the whole waste pan means allows visual inspection therethrough. Preferably, the waste pan means is made substantially of clear plastic. Most preferably, the waste pan means is a substantially clear plastic square or disc. Preferably, the waste pan means is approximately 3 millimetres thick.

Preferably, a person is able to see directly through the or each at least part of the waste pan means, so as to locate the waste outlet. Preferably, a person is able to see directly through the or each at least part of the waste pan means, so as to locate an adaptor or connecting means used on a waste outlet. In an alternative form of the invention, visual inspection may be made indirectly through use of a detection system. The detection system may include an electronic detector, camera or similar device that relays information to a monitor wherein a suitable position for the or each at least one aperture in the waste pan means can be determined, substantially aligned with the opening of the waste outlet.

Preferably, the forming of the or each at least one aperture includes drilling of holes. Alternatively, the at least one aperture may be formed in any suitable manner. The holes may be pilot holes. The pilot holes may be expanded to a desired size after drilling. The pilot holes are preferably formed with the waste pan in situ while the location of the waste outlet can be visually inspected and the waste pan removed to expand the pilot holes to form one or more apertures of a desired form and size. Alternatively, the holes and aperture may be formed directly in a single action. Preferably, the or each aperture is a substantially circular hole. The apertures may take any suitable shape or form.

The suitable positioning of the or each at least one aperture is preferably substantially aligned with the opening of the waste outlet. The or each at least one aperture may be formed at any suitable position on the waste pan. Preferably, the or each at least one aperture is formed in a position other than centrally of the waste pan. Alternatively, the or each at least one aperture may be formed centrally. The or each at least one aperture can be formed at any suitable position in the waste pan. Preferably, the position of the or each at least one aperture is such that the or each at least one aperture is substantially directly above the opening of the waste outlet.

Alignment between the or each at least one aperture in the waste pan means and the opening in the waste outlet is preferably such that waste will fall or flow directly. Preferably, the waste flows straight down out of the waste pan means, into the waste outlet. Preferably, the alignment between at least one aperture in the waste pan means and the opening in the waste outlet is a perfect alignment.

Preferably, during installation the waste pan means is connected to the waste outlet. A connecting means may be included between the waste pan means and the waste outlet. The connecting means may take any suitable form. The connecting means may be attached to the waste pan means and or the waste outlet. The connecting means may take any suitable form or shape. Preferably, the connecting means acts as a conduit. Most preferably, waste flows from the waste pan means through the connecting means in to the waste outlet. Preferably, the connecting means includes a body and at least one lip. Preferably, the connecting means includes at least one opening. Preferably, the connecting means includes a lip substantially around the opening.

Most preferably, the connecting means is adapted so at least part of the connecting means fits into or about the waste outlet. Preferably, at least part of the body of the connecting means is adapted to fit within the waste outlet. The body of the connecting means may be a pipe adapted to fit within the waste outlet in a tight fit. The body of the connecting means may be glued or otherwise affixed within the waste outlet. Optionally, the connecting means may be screwed or otherwise attached to a floor or surface by the or each lip. Preferably, the connecting means is connected to the waste outlet before the installation of the waste pan means.

Preferably, at least part of the connecting means is adapted to attach to the waste pan means. Preferably, the or each lip of the connecting means may be attached to the waste pan means. Preferably, one or more holes are formed in the or each lip of the connecting means. The holes are preferably made at the same time as at least one aperture is made in the waste pan means. The or each lip of the connecting means may include 3 holes spaced around the perimeter of the connecting means. Optionally, the or each lip of the connecting means may include a groove. The groove in the lip of the connecting means may be adapted to assist in attaching the connecting means to the waste pan means. Preferably, during installation the or each lip of the connecting means is glued to the waste pan means. Preferably, the connecting means is attached to the waste pan means by screws through holes in the waste pan means and holes in the or each lip of the connecting means. Preferably, the holes in the or each lip of the connecting means are formed at the same time as the or each at least one aperture formed in the waste pan means. The holes may be drilled through the waste pan means into the or each lip of the connecting means. Pilot holes may be formed, or drilled first and later expanded to the desired dimensions. Preferably, four pilot holes are drilled in the waste pan in situ after visual inspection of the location of the waste outlet therethrough, a central hole is drilled through the waste pan into the opening of the waste outlet, three further holes are drilled through the waste pan and the or each lip of the connecting means lying below to form three corresponding holes through the waste pan and around the perimeter of the or each lip of the connecting means, the waste pan is then removed and central hole is expanded to form an aperture for the flow of waste before the waste pan is secured in place to the connection means by use of screws through the three holes in the waste pan and corresponding holes in the or each lip of the connecting means below. Preferably, the three remaining pilot holes are also expanded before the waste pan is secured in place.

Preferably, the connecting means is attached to the waste outlet before being attached to the waste pan means. Preferably, the connecting means has a flat upper surface on which the waste pan sits. Optionally the connecting means includes a sloped upper surface. The slope may be any suitable angle from the horizontal such that a fall can be observed from a high side to a lower side. The fall may be substantially 5 degrees. Preferably, in one form of the invention, in use, the waste pan means rests on the sloped upper surface of the connecting means whereby the waste pan means has a fall toward the opening in the waste outlet. Once the waste pan means is attached to the connecting means the fall of the waste pan may be at least 5 degrees. Once the waste pan means is attached to the connecting means the fall of the waste pan may be at least 5 degrees to where joined to the connecting means. The fall of the waste pan means may direct waste to at least one aperture in the waste pan means. The connecting means may be made of any suitable material including metal including brass, or plastic, or combinations thereof. Preferably, the connecting means is made of plastic.

Preferably, a height gauge is used with the invention to establish that the outlet pipe or connecting means are at the correct height or level. Preferably, the height gauge is adapted to fit in the recess including on any lips or projections if present so as to be level if the connecting means and or waste outlet are at the correct height or level. The height gauge may be adapted for use to check the height and or level of a connecting means with a flat upper surface. The height gauge may be also or separately be adapted for use to check the height and or level of a connecting means with an upper surface including a fall. The height gauge may take any suitable form. Preferably, the height gauge is a suitably shaped piece of plastic. Preferably, the height gauge is supplied with the waste fitting.

Preferably, the or each at least one aperture is formed in the waste pan means in situ after visual inspection therethrough of the position of the opening of the waste outlet.

Preferably, visual inspection through the or each at least one part of the waste pan means enables the substantial alignment of the or each at least one aperture and the opening in the waste outlet whereby once the waste pan means and the waste outlet are connected waste that flows into the waste pan means can flow into the waste outlet. Alternatively, the or each at least one aperture may be already formed in the waste pan means and visual inspection of the position of the waste outlet enables substantial alignment of the or each at least one aperture and the opening in the waste outlet.

Preferably, the connecting means is installed in and around the opening of the waste outlet and, after visual inspection through the waste pan means, the or each at least one aperture is formed in the waste pan means. Preferably, visual inspection through the or each at least one part of the waste pan means enables the substantial alignment of the or each at least one aperture and the connecting means attached to the waste outlet whereby once the waste pan means is connected to the waste outlet by the connecting means waste that flows into the waste pan means can flow into the waste outlet.

Preferably, a waste cap is included. The waste cap may take any suitable form. Preferably, the waste cap is the same shape in profile from above as the recess. Preferably, the waste cap is adapted to fit within the recess with a substantially small gap between the waste cap and the wall of the recess. Preferably, the waste cap is square in profile from above and adapted to fit into a square recess. Preferably, the waste cap is circular in profile from above adapted to fit into a circular recess. The waste cap may be made of any suitable material including plastic, stainless steel or other metal, acrylic or fibreglass or any combinations thereof. Preferably, the waste cap is made of acrylic and fibreglass. The waste cap may be coloured or styled to match, or contrast, the shower, bath, spa or the like to which it is fitted.

Preferably, a plurality of lugs is included on the waste cap to substantially maintain a gap between the waste cap and the wall of the recess. The plurality of lugs may take any suitable shape or form.

Preferably, the waste cap includes one or more cut-outs which allow the flow of waste therethrough. The cut-outs may be any suitable shape including rectangular including square, circular, or irregular or any combination thereof. Preferably, there are several rectangular cut-outs spaced around the perimeter of the waste cap.

Most preferably, the waste pan means is substantially wider than the opening of the waste outlet. The width of the waste pan means may allow that there be greater scope for error in the alignment between the waste fitting and the waste outlet. The wide waste pan makes installation of the waste fitting easier. For example, if the positioning of a shower base is calculated a few millimetres or even centimetres inaccurately visual inspection through the or each at least part of the waste pan means enables location of the waste outlet and positioning of the or each at least one aperture anywhere in that wide waste pan means such that at least one aperture in the waste pan means and the opening in the waste outlet are substantially aligned. Preferably, the waste fitting can be installed without the need for plumbdingers or the like.

Installation of the waste fitting may occur during original installation, renovation or repair of a shower, bath, spa or the like.

Preferably, where the waste fitting is being installed in a shower, bath, spa or the like, use of the waste fitting minimizes or removes the need for the shower, bath, spa or the like to be accessed from below the shower, bath, spa or the like, once the shower base, bath, spa or the like is in place. Preferably, where the waste fitting is installed in a shower base, no access need be made below the shower base when installing the waste fitting once the shower base is in place as visual inspection of the position of the waste outlet can be made through the waste fitting.

The waste cap may include a lifting means for facilitating removal of the waste cap from the recess. The lifting means may take any suitable form. The lifting means may be one or more grooves around the perimeter of the waste cap. Alternatively, the lifting means may be one or more slots. Preferably, application of a tool, such as a spoon, into the groove or slot enables the waste cap to be levered out of the recess.

Preferably, where the waste fitting is installed in a bath or spa or the like one or more plug is included to entrap water. The or each plug may take any suitable form. Preferably, the or each plug is a circular soft plastic plug, installed around a perimeter of a waste cap.

Where the waste fitting is installed in a shower, bath, spa or the like above a timber floor, stiffeners may be included. The stiffeners may take any suitable form. The stiffeners may be in the form of a washer and screw arrangement. In one form of the invention, the stiffeners may be shaped to surround at least part of the waste outlet and are attach to the timber floor. Alternatively, stiffeners may be shaped to surround at least part of the connecting means and attached to the timber floor.

INDUSTRIAL APPLICABILITY

The invention provides a waste fitting that enables visual inspection through the waste pan during installation of a shower, bath or the like, to facilitate connection to the underlying plumbing.

BRIEF DESCRIPTION OF THE DRAWINGS

The invention will now be described in connection with non-limiting preferred embodiments with reference to the accompanying drawings, in which.

DETAILED DESCRIPTION OF THE INVENTION

Referring to FIGS. 1 to 16, a first preferred embodiment of the invention will be described in detail, where waste fitting 1 includes waste cap 10, waste pan 12 and adaptor 14*a*. Waste fitting 1 in FIGS. 1, 2, 3, (10 and 11 showing the shower base only) and 12 illustrate the invention installed in a shower, the shower having a shower base 16; the rest of the shower is not shown.

Figure 1:
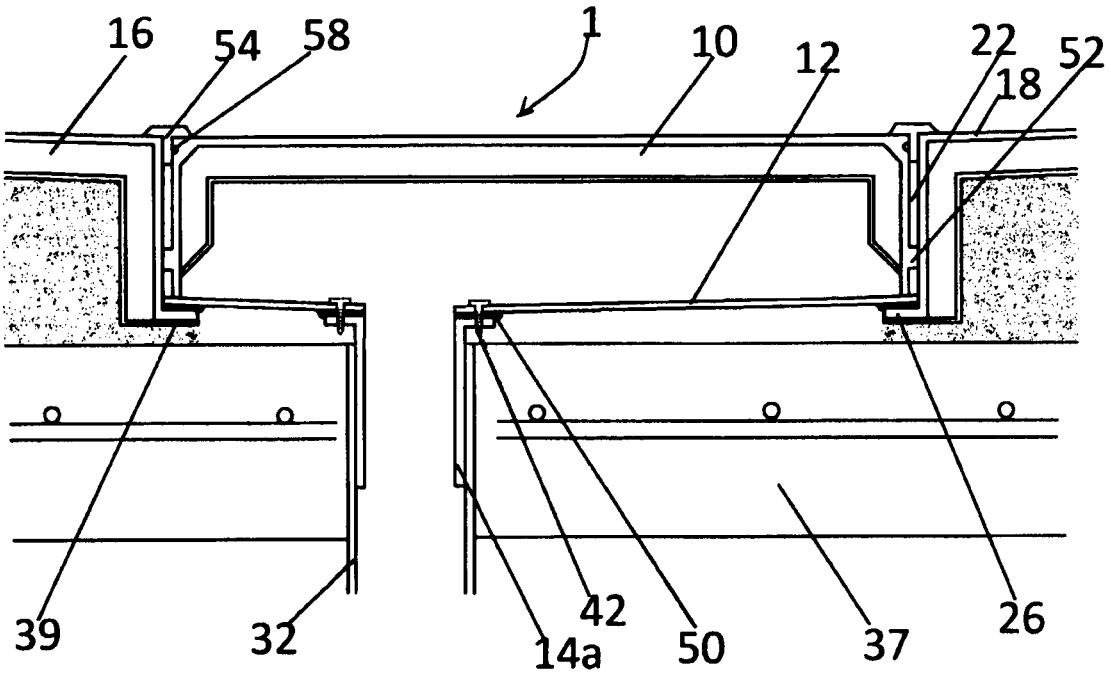
FIG. 1 is a cross-sectional view from the side of a waste fitting according to the present invention in a first preferred embodiment (circular), the waste fitting being installed in a shower base.
Figure 2:
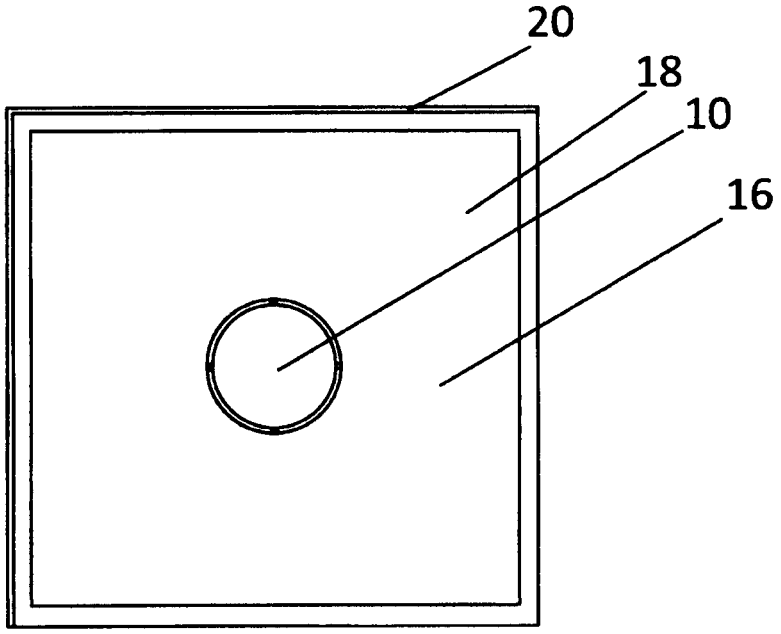
FIG. 2 is a plan view from above of the waste fitting of FIG. 1.
Figure 3:
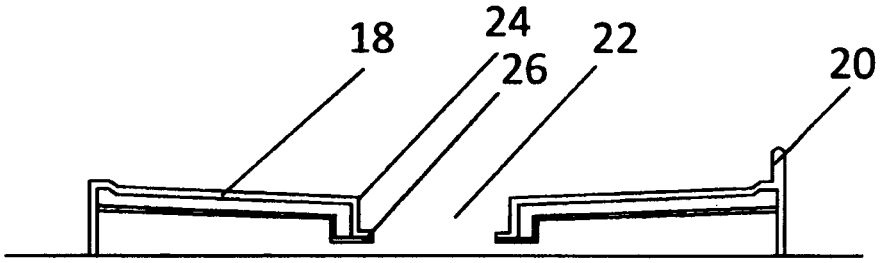
FIG. 3 is a cross-sectional view of the shower base of FIG. 2 with the waste cap and other parts of the waste fitting removed (the plumbing below is not shown)

Referring to FIGS. 1 to 3 in particular shower base 16 has floor 18 and waterproofing edge 20, running around two sides for capture of falling shower water and to prevent the water overflowing. Alternatively, waterproofing edge 20 could be present on all four, three or only 1 side, or omitted as is suitable to the manner in which the shower is installed. Shower base 16 and waste cap 10 may be made of any suitable material but are illustrated made of acrylic over fibreglass. The same or different colours or textures may be used for the shower base 16 and waste cap 10 to create a stylish look. The particular form of the shower base is determined by the desired style of the customer, and is not limited to the shower base 16 as shown.

Shower base 16 includes recess 22 into which waste fitting 1 is installed. Recess 22 of shower base 16 has wall 24 (refer FIG. 3) and lip 26. Waste fitting 1 sits within recess 22 with waste pan 12 sitting on lip 26. Waste fitting 1 is configured to fit in recess 22 with a small gap around waste cap 10. Recess 22 and corresponding waste fitting 1 are shown as circular in cross-section but may be any suitable shape including rectangular including square, diamond or hexagonal, for example.

Figure 4:
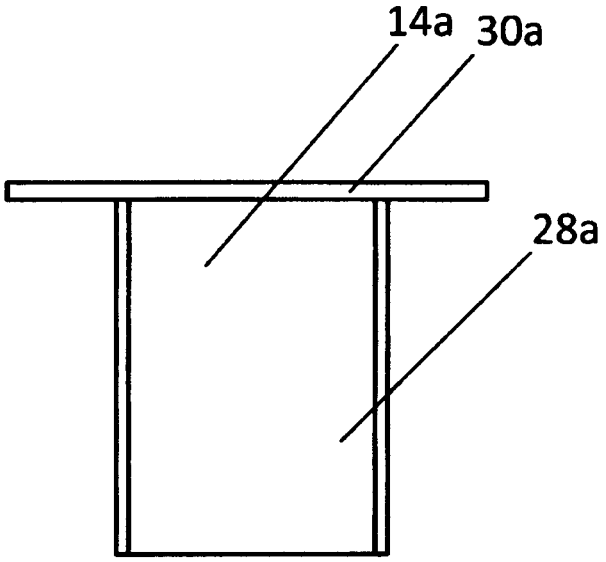
FIG. 4 is a side view of a standard adaptor of the waste fitting of FIG. 1.
Figure 5:
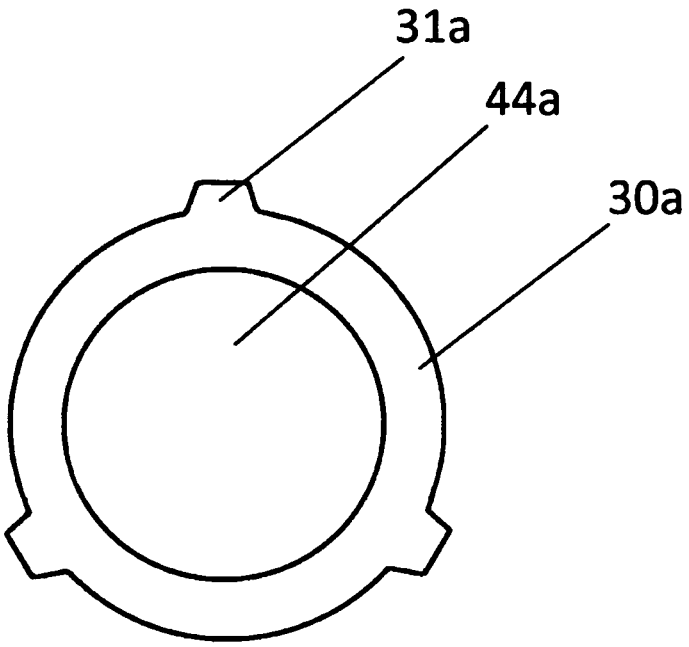
FIG. 5 is a plan view from above of the adaptor of FIG. 4.

Referring to FIGS. 4 and 5, in particular, a standard adaptor 14*a* is illustrated having body 28*a*, collar 30*a* and tabs 31*a*. Adaptor 14*a* is configured to fit into outlet pipe 32 with body 28*a* sitting within outlet pipe 32 and collar 30*a* above the body 28*a*.

Figure 6:
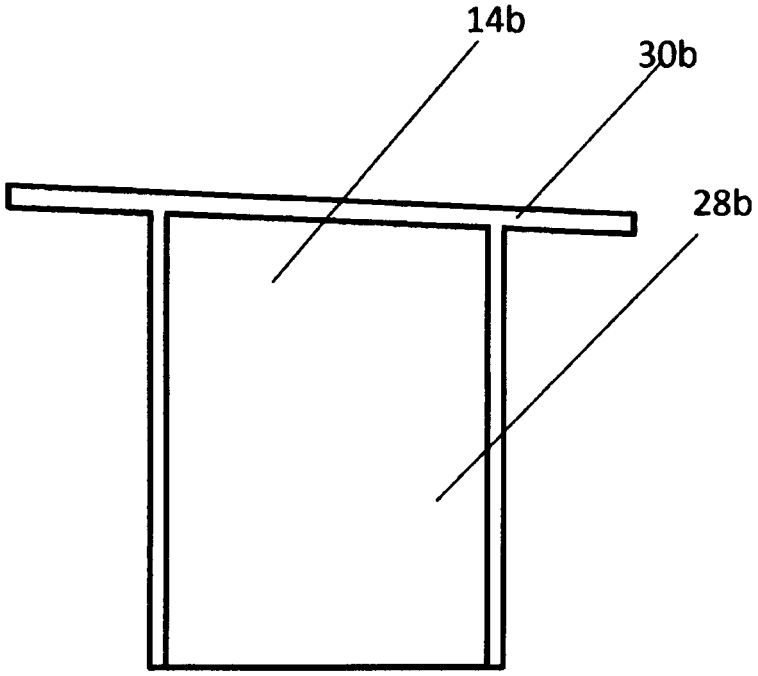
FIG. 6 is a side view of an alternative adaptor having an extra fall.
Figure 7:
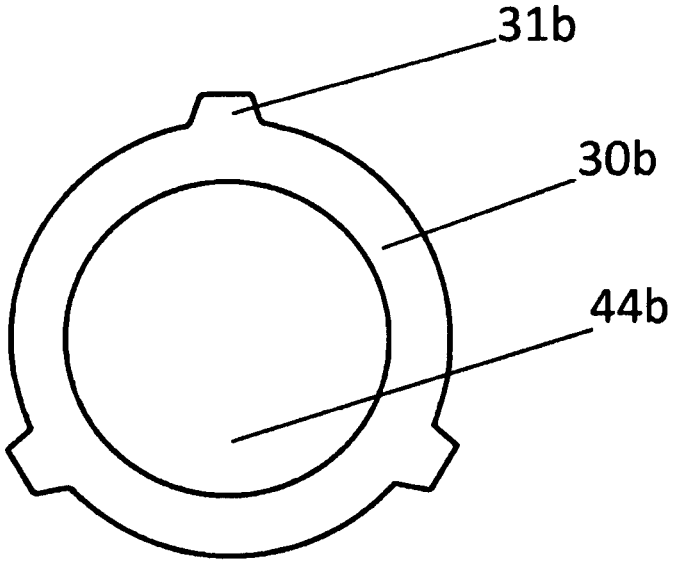
FIG. 7 is a plan view from above of the alternative adaptor of FIG. 6.
Figure 14:
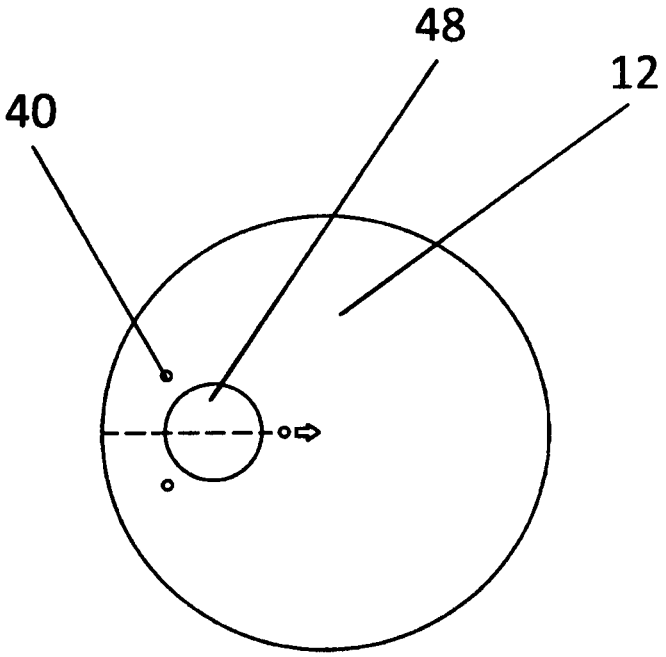
FIG. 14 is a plan view from above of a waste pan of the waste fitting of FIG. 1 after the holes and aperture have been formed for use with the adaptor of FIGS. 6 and 7 including an indication of the direction of fall.

FIGS. 6 and 7 show an alternative adaptor 14*b* including an extra fall of approximately 5 degrees. Alternative adaptor 14*b* is illustrated having body 28*b* and collar 30*b*, collar 30*b* including tabs 31*b*. Adaptor 14 is configured to fit into outlet pipe 32 with body 28*b* sitting within outlet pipe 32, with collar 30*b* above the body 28*b*. The direction of the extra fall of adaptor 14*b* is illustrated in FIG. 14.

Figure 8:
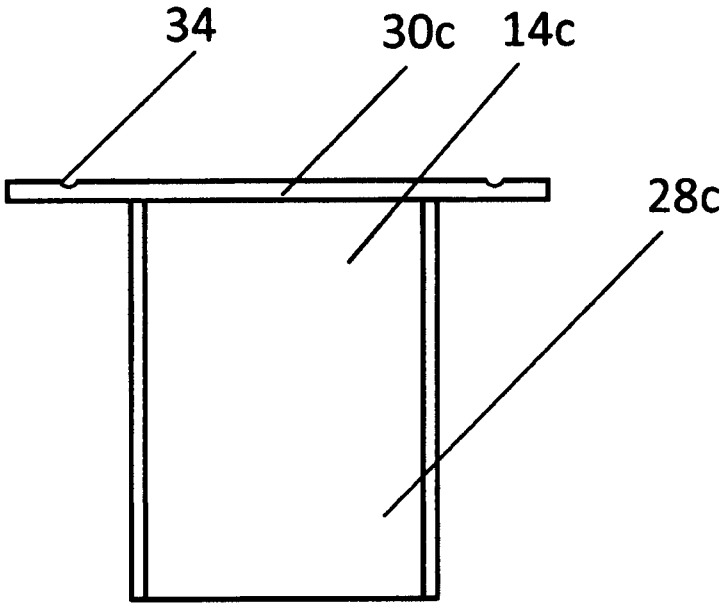
FIG. 8 is a side view of a variation of the adaptor of FIG. 4, including bonding grooves.
Figure 9:
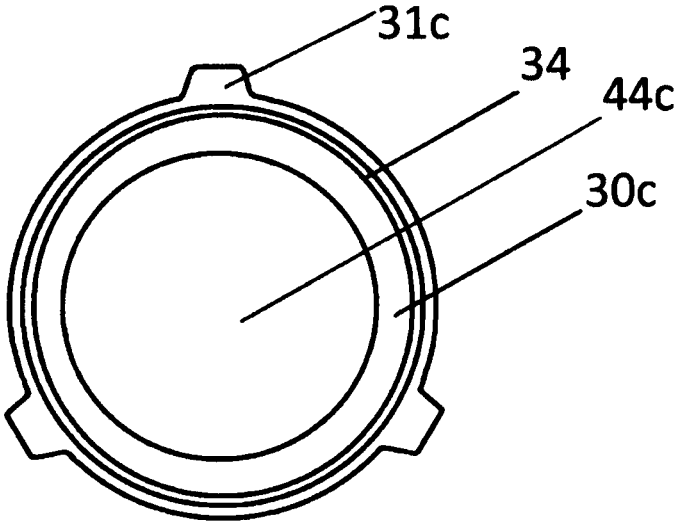
FIG. 9 is a plan view from above of the adaptor of FIG. 8.

FIGS. 8 and 9 shows adaptor 14*c*, which is a variation to adaptor 14*a*, including optional bonding grooves 34 to assist bonding when used with glue or sealant as described below. Adaptor 14*c* does not include the extra fall of adaptor 14*b*. Adapter 14*c* is illustrated having body 28*c* and collar 30*c*, including tabs 31*c*. Adapter 14*c* can be used exactly as described for adaptor 14*a* and is configured to fit into outlet pipe 32 with body 28*c* sitting within outlet pipe 32, with collar 30*c* above the body 28*c*.

Adaptor 14*a*, 14*b* and 14*c* are all shown made of plastic. However adaptor 14*a*, 14*b* or 14*c* may be made of any suitable material including brass or other metal, for example, or a combination of materials.

Figure 10:
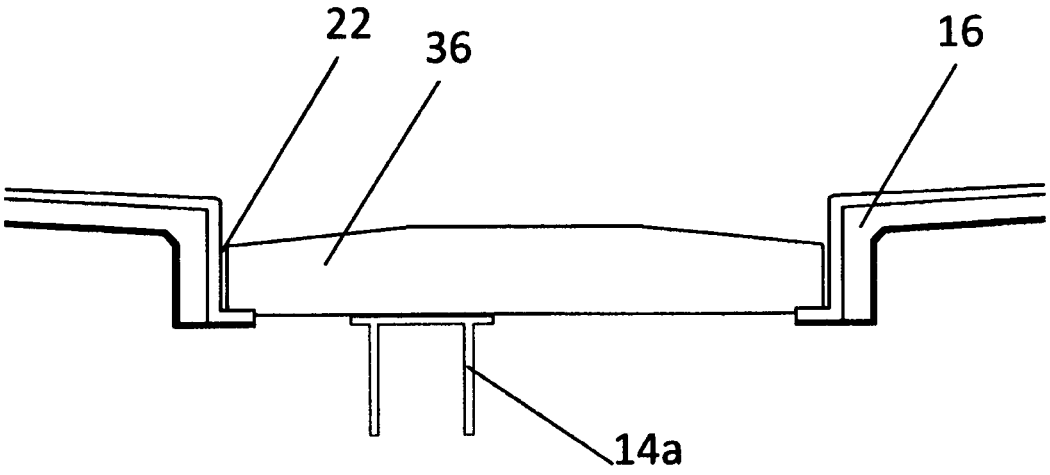
FIG. 10 is a cross-sectional view of the adaptor of FIGS. 4 and 5 in use with a height gauge.

FIG. 10 shows recess 22 in shower base 16, with adapter 14*a* in position on outlet pipe 32 (not shown), outlet pipe 32 having been cut across level with the cement floor, with height gauge 36. Height gauge 36 is supplied with the waste fitting 1 and is used by the person installing the waste fitting to check that adaptor 14*a* as installed (see the description below) on cut outlet pipe 32 is level. As illustrated, height gauge 36 is a piece of plastic, flat on one side that is configured to fit inside recess 22 and rest on adaptor 14*a* if adaptor 14*a* has been positioned and aligned correctly on outlet pipe 32. If adapter 14*a* is not level, outlet pipe 32 may need to be trimmed.

Figure 11:
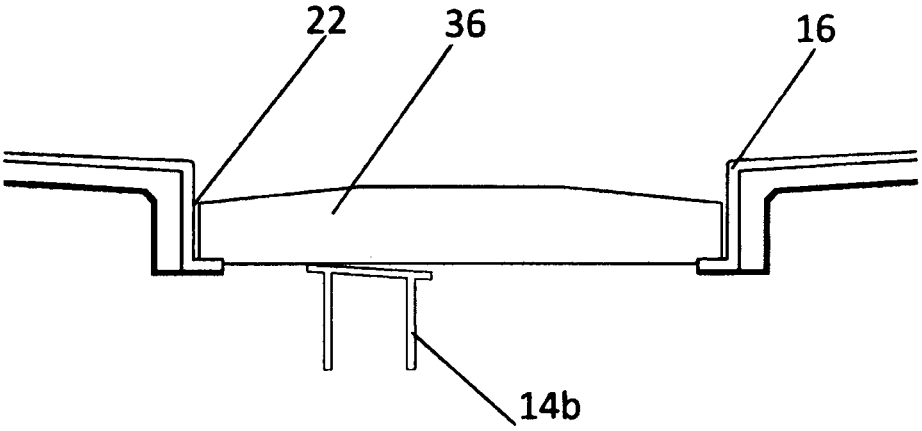
FIG. 11 is a cross-sectional view of the adaptor of FIGS. 6 and 7 in use with the height gauge of FIG. 10.

FIG. 11 shows recess 22 in shower base 16, with adaptor 14*b* in position used with height gauge 36, as described for use with adaptor 14*a*.

Figure 12:
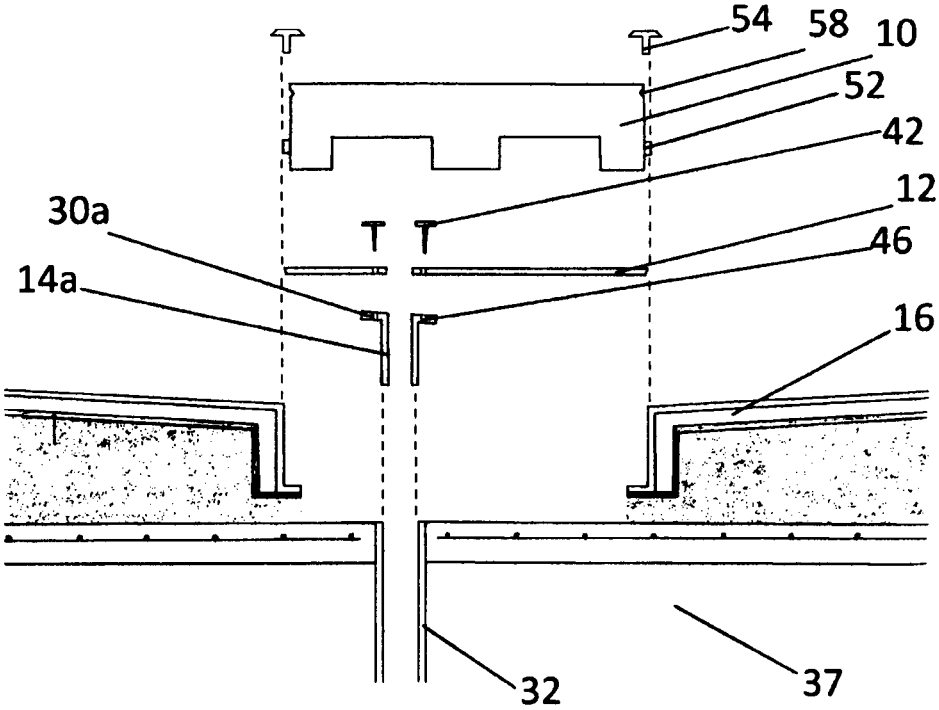
FIG. 12 is a cross-sectional exploded side view of the waste fitting of FIG. 1 being installed in the shower base.
Figure 13:
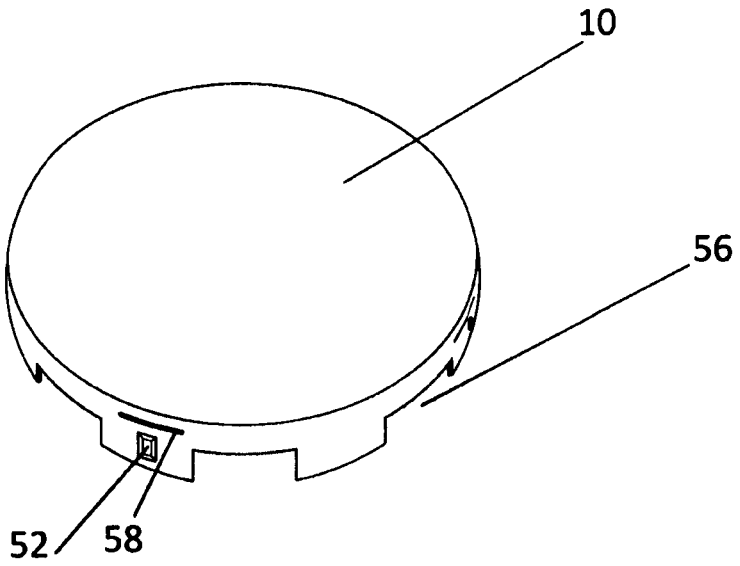
FIG. 13 is a perspective view of the waste cap of FIGS. 1, 2 and 12.
Figure 15:
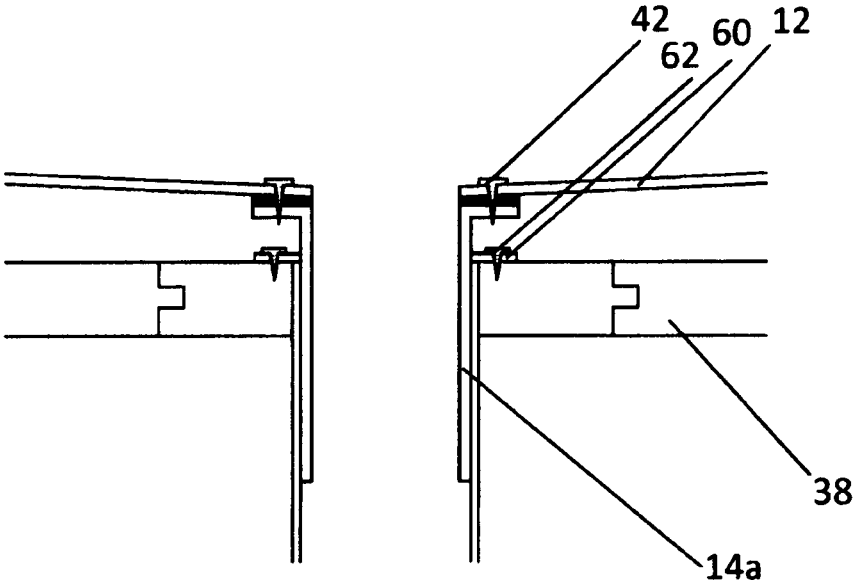
FIG. 15 is a cross-sectional view from the side of the waste fitting of FIG. 1, installed in a timber floor.

FIG. 12 illustrates the various parts of waste fitting 1 as being installed in shower base 16. To install the waste fitting 1, outlet pipe 32 is cut-off, level with the floor 37. Floor 37 as illustrated in FIGS. 1 and 12 is a concrete floor. In FIG. 15 waste fitting 1 is illustrated fitted in timber floor 38.

Mortar 39 is mixed and applied below lip 26 and below shower base 16 to support waste fitting 1 (refer FIG. 1). Further solid packing may be used below lip 26 to avoid movement between lip 26 and floor 37 whilst the mortar 39 is soft, but is not illustrated here.

Adaptor 14*a* is placed on outlet pipe 32 and height gauge 36 used to check that adaptor 14*a* will sit level. Height gauge 36 is then removed, as is adaptor 14*a*. Adaptor 14*a* is primed with PVC priming fluid and glued (glue and primer not shown) into outlet pipe 32; any suitable glue and primer may be used, or the primer or glue may be omitted. If adaptor 14*c* is used the glue sits in the bonding groove 34 to assist bonding. However, bonding will be sufficiently secure if optional bonding groove 34 is omitted. If adaptor 14*b* is used the high side of collar 30*b* is 2 mm below the top edge of lip 26 and the low side of collar 30*b* points to the centre of recess 22. During installation using adaptor 14*b* the screwing pressure between lip 26 and waste pan 12 contorts the fall in waste pan 12 until finally installed with a further downward fall created to the low side of collar 30*b*. The downward fall of the waste pan 12 after installation using 14*b* is preferably about 5 degrees to where connected to adaptor 14*b*. Installation of standard adaptor 14*a* is as described above but one side is the same level as the other, the adaptor can be installed in any orientation and does not lead to a fall across waste pan 12.

Waste pan 12 is dropped or otherwise put into recess 22 over adapter 14*a* and outlet pipe 32. Waste pan 12 as illustrated is a circular disc of clear plastic. Waste pan 12 could, instead, have a floor with walls and a round or square floor or any suitable pan shape for receipt of waste. Once waste pan 12 is in position, adapter 14*a* leading to outlet pipe 32 can be seen through clear waste pan 12. The ability to be able to make visual inspection through and below waste pan 12 is an important part of the invention. Although in the described embodiment clear plastic waste pan 12 is used to allow visual inspection of the components below, other methods of allowing visual inspection might include a waste pan having one or more transparent parts. A cover may be included to cover all or some of the transparent parts of the waste pan or the waste pan as a whole (excepting to allow waste to exit) for use after installation has occurred. Optionally pool lights or similar may be installed in the waste fitting during installation, if desired. Waste pan 12 could optionally include a shaped, bevelled or angled edge of 30 degrees from the horizontal to facilitate removal during installation and to assist and strengthen the bonding to lip 26.

With waste pan 12 in place collar 30*a* can be seen through the clear plastic. In this way the positions for forming holes (not labelled) in collar 30*a* and corresponding holes 40 (not labelled) for screws 42 in waste pan 12 can be readily determined, a significant advantage over existing methods. Screws 42 are stainless steel screws but any suitable alternative material or other fixing may be used. Three pilot holes (not shown) of 2.5 millimetres in diameter are drilled in situ through waste pan 12 and collar 30*a* in a single operation. A fourth pilot hole (not shown) is also drilled aligned central to the outlet pipe 32, corresponding with aperture 44*a* in collar 30*a* of adapter 14*a*. Tabs 31*a* (or tabs 31*b* or 31*c*) can flex upwards to a certain extend to allow for installation at the extreme extent of a fit. Each of the four pilot holes in waste pan 12 is a simple drill hole which can be easily and readily formed while the waste pan 12 is in situ, in recess 22 resting on lip 26 such that the positions of collar 30*a* and aperture 44*a* can be easily seen so as to determine where on waste pan 12 the holes should be drilled. Waste pan 12 is then removed by being hooked out of recess 22 such as by use of a piece of bent wire or a screw (not shown). Holes 46 (refer FIG. 12) formed in collar 30*a* are widened to an appropriate width. The three holes 40 for screws 42 in waste pan 12 are formed by enlarging three of the pilot holes to a size suitable to accommodate screws 42. The fourth pilot hole (not shown) is enlarged to a width of 38 millimetres to form aperture 48, ultimately for receipt of the flow of waste. Other suitable widths may be used depending on the width of outlet pipe 32. PVC priming fluid (not shown) and silicone 50 (or other suitable glue or sealant) is applied to the upper surface of collar 30*a*, and to lip 26. Waste pan 12 is then replaced in recess 22 on lips 26 and holes 40 in waste pan 12 aligned with holes 42 in collar 30*a* of adaptor 14*a* below. Screws 42 are put through the aligned holes 42 and 40 and screws 42 tightened to attach through holes 40 in waste pan 12 and corresponding holes 42 in collar 30*a*. In this way waste pan 12 is attached to collar 30*a*, which in turn is attached to outlet pipe 32.

If adaptor 14*b* is used instead the fall of collar 30*b* applies to waste pan 12 so there is a fall of approximately 2 millimetres to the high side of adaptor 14*b* then a further fall of approximately 5 degrees from the high side to the low side of adaptor 14*b*. In FIG. 14 the direction of the downward fall created by adaptor 14*b* in waste pan 12 is indicated by an arrow. Adaptor 14*b* should not be used over the centre, maximum usage is obtained when the centre of adaptor 14*b* reaches the centre of the pan.

Since waste pan 12 is clear, the quality of the silicone seal can be inspected, while cleaning up any excess silicone 50. Ascetic cure silicone is used in the illustrated embodiment but any suitable silicone or other sealant may be used. Finally, waste cap 10 can be positioned into recess 22 of shower base 16 to cover waste pan 12 and all that can be seen below. Waste cap 10 has lugs 52 which maintain waste cap 10 an even distance from wall 24 of recess 22 so there is a small gap all the way around. Use of a small gap, rather than a grill discourages mosquitoes and other insects that may enter or exit through traditional waste fittings. Lugs 52 are used to maintain a gap between wall 24 or recess 22 and waste cap 10 to allow free flow of water and waste. Plug 54 is illustrated as circular soft plastic plug applied into the small gap around the perimeter of waste cap 10 between recess 22, wall 24 and waste cap 10 to entrap water. Use of plug 54 helps entrap water when waste fitting 1 is used with a bath, spa or the like.

In use, waste flows towards recess 22, due to the fall in floor 18 of shower base 16, and into waste fitting 1 by means of the small gap around waste cap 10. Waste cap 10 includes a number of cut-outs 56 (refer to FIGS. 12, 13 and 16) through which waste flows onto waste pan 12. Cut-outs 56 are illustrated as rectangular cut-outs but may be any suitable shape. The fall of waste pan 12 directs the flow of waste through aperture 48 in waste pan 12, aperture 44*a* in adaptor 14*a* (or 44*b* in adaptor 14*b* or 44*c* in adaptor 14*c* as appropriate) and ultimately down outlet pipe 32.

Waste cap 10 can be readily removed to allow inspection through waste pan 12 to check the installation or for cleaning of waste pan 12. Removal of waste cap 10 can be achieved by use of a household spoon or similar (not shown). The tip of the spoon is passed into recess 22 between wall 24 and waste cap 10 and into lifting groove 58. As illustrated, lifting grooves 58 are a series of short a grooves that runs around the perimeter of waste cap 10. In an alternative embodiment, lifting grooves 58 may be a pair of opposing slots, several slots or a single groove that runs around the entire perimeter of waste cap 10. Waste cap 10 can be prised out of recess 22 by leverage of the spoon in lifting grooves 58.

Referring to FIG. 15, waste fitting 1 is fitted in timber floor 38. Waste fitting 1 is fitted exactly as described above for a concrete floor but stiffeners 60 are also used on either side of outlet pipe 32, attached to the topside of timber floor 38 to stop outlet pipe 32 from retracting when pressure is applied to waste pan 12 and to provide additional support. Stiffeners 60 are shown used including metal washers (not labelled) with additional screws 62 to attach adaptor 14*a* to the underlying timber structure. Stiffeners 60 may be made of any suitable material such as plastic or metal to provide support to the waste fitting 1 and the surrounding area of timber floor 38. Screws 62 are applied through holes 62 in stiffeners 60, and holes (not shown) formed in the topside of timber floor 38, and tightened until firm. Screws 62 as illustrated are stainless steel screws but alternative fixings may be used. Glue (not shown) may also be used to attach stiffeners 60 to outlet pipe 32.

Figure 16:
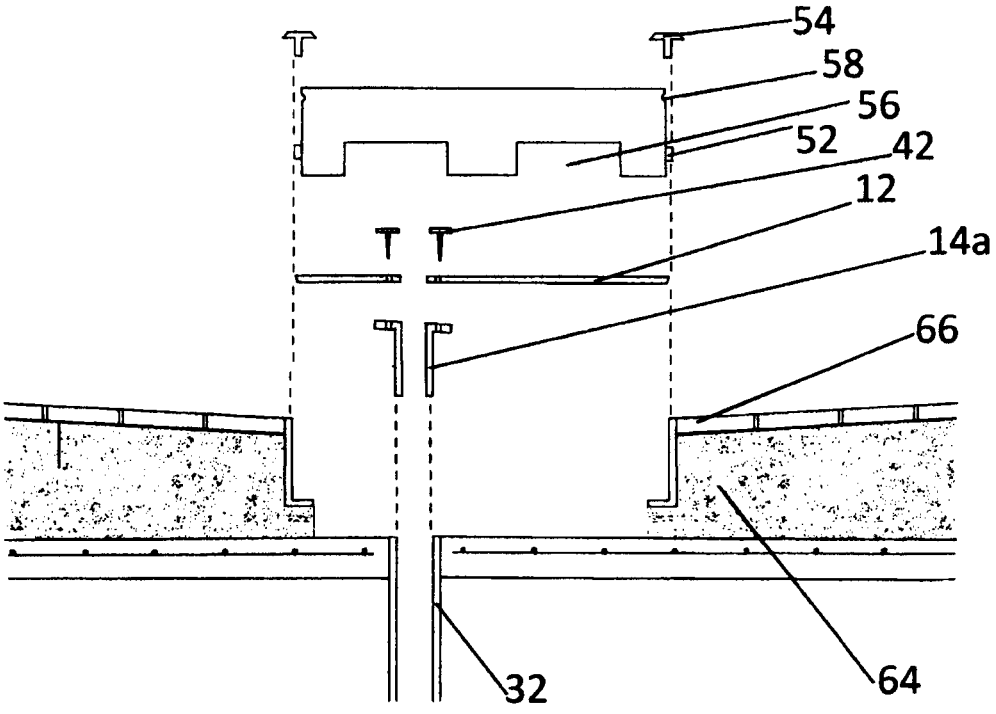
FIG. 16 is cross-sectional exploded view from the side of the waste fitting of FIG. 1, being installed in a roman bath.

Referring to FIG. 16, waste fitting 1 is shown being installed in a roman bath 64, having tiles 66. In all other aspects waste fitting 1 is installed as in a shower base 16, and the same numbering has been used.

Referring to FIGS. 17 to 21, a second most preferred embodiment of the invention will be described in detail with numerals similar to the first. Waste fitting 101 includes waste cap 110, waste pan 112 and adaptor 114*a* and is installed in shower base 116. As can be seen waste fitting 101 is square shaped which differs from the circular first preferred embodiment waste fitting 1.

Figure 17:
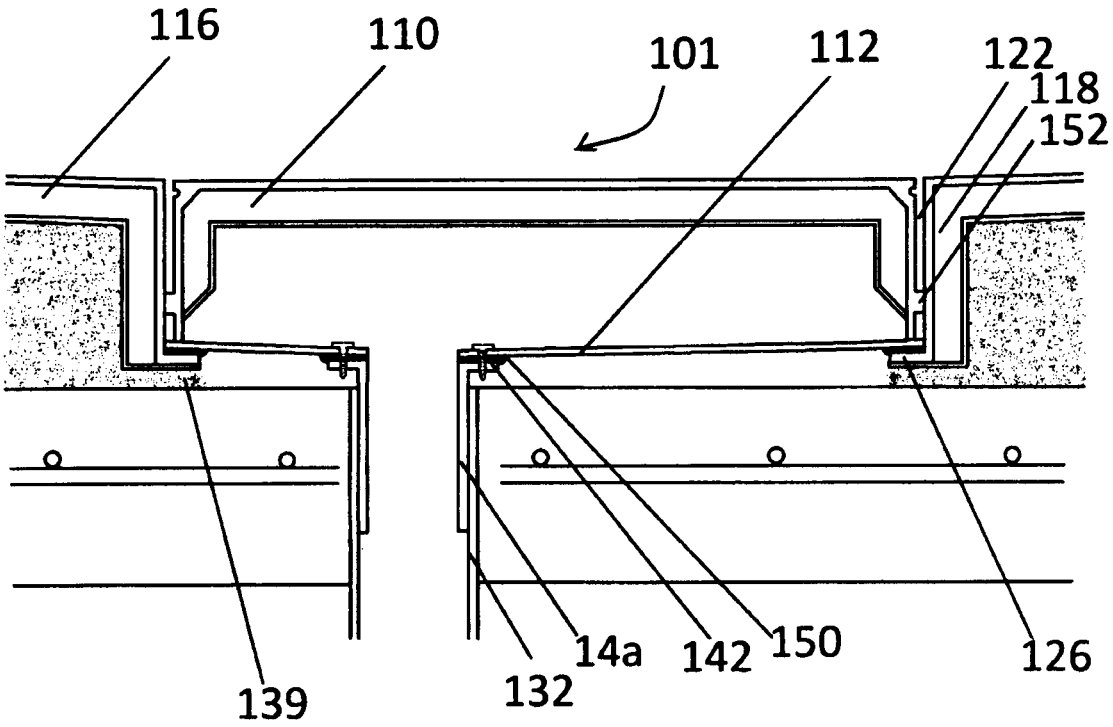
FIG. 17 is a cross-sectional view from the side of a waste fitting according to the present invention in a second preferred embodiment (square), the waste fitting being installed in a shower base.
Figure 18:
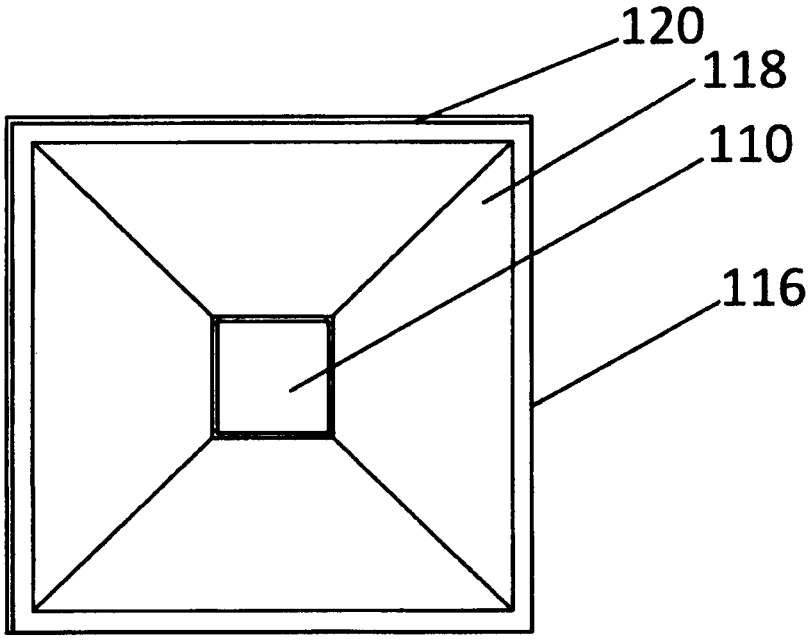
FIG. 18 is a plan view from above of the waste fitting of FIG. 17 installed in the shower base.
Figure 19:
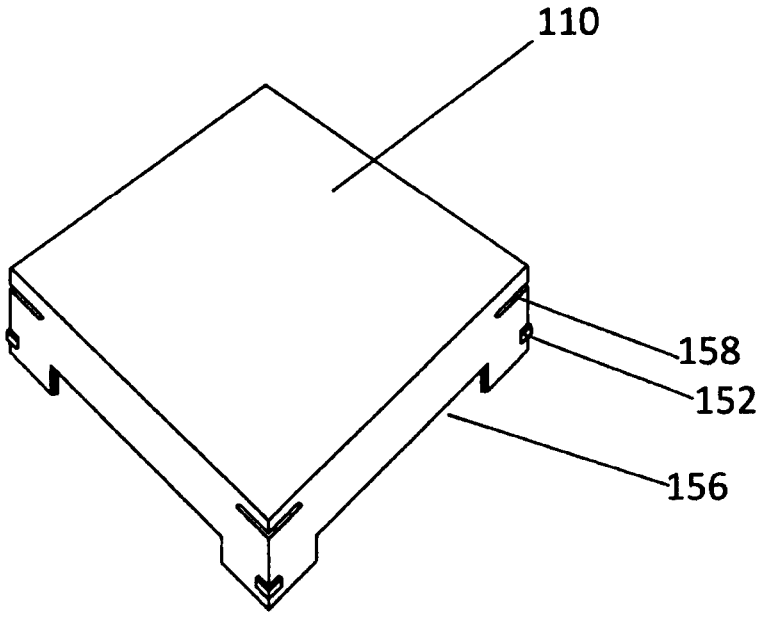
FIG. 19 is a perspective view of the waste cap of FIGS. 17 and 18.

Referring to FIGS. 17 to 19 in particular, shower base 116 has floor 118 and waterproofing edge 120, running around two sides for capture of falling shower water and to prevent the water overflowing. Alternatively, waterproofing edge 120 could be present on all four, three or only 1 side, or omitted as is suitable to the manner in which the shower is installed. Shower base 116 and waste cap 110 may be made of any suitable material but are illustrated made of acrylic over fibreglass.

Shower base 116 includes square recess 122 into which square waste fitting 101 is installed. Recess 122 of shower base 116 has wall 124 and lip 126. Waste fitting 101 sits within recess 122 with waste pan 112 sitting on lip 126. Waste fitting 101 is configured to fit in recess 122 with a small gap around waste cap 110.

Standard adaptor 114*a*, is illustrated having body 128*a*, collar 130*a* and tabs (not labelled). Adaptor 114*a* is configured to fit into outlet pipe 132 with body 128*a* sitting within outlet pipe 132, with collar 130*a* above the body 128*a*. Adaptor 114*a* is illustrated made of plastic; but may be made of other suitable materials.

As described for the first preferred embodiment, alternative adaptor 14*b*, including an extra fall, or adaptor 14*c*, which is a variation to adaptor 14*a* including optional bonding grooves 34, could be used instead of 114*a*.

Figure 20:
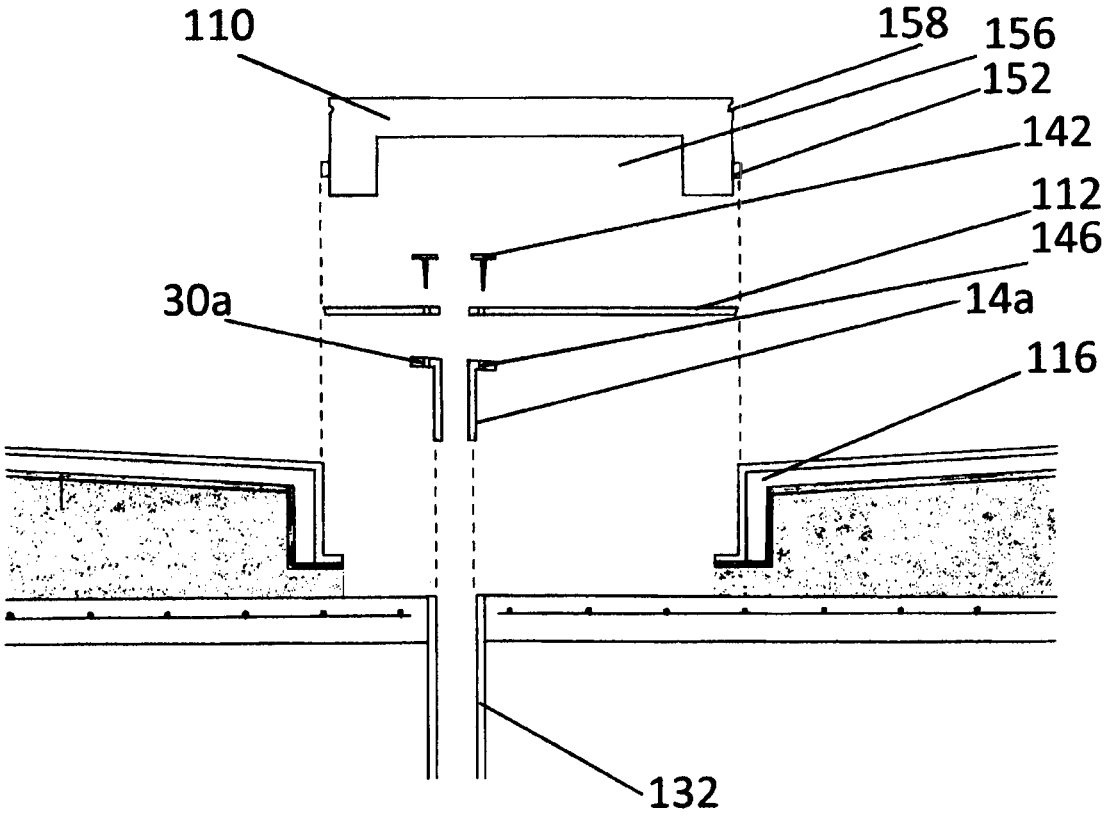
FIG. 20 is a cross-sectional exploded view of the waste fitting of FIG. 17 from the side, being installed in the shower base.

FIG. 20 shows the process of installation of waste fitting 101, including recess 122 in shower base 116, with adaptor 114*a* placed in position on outlet pipe 132. Outlet pipe 132 is cut across level with the cement floor 37 before installation of adaptor 114*a*. To check that outlet pipe 132 is cut correctly and is level height gauge 36 as described for the previous embodiment is be used. Waste fitting 101 could readily be fitted in a timber floor, with or without the use of stiffeners as described above.

Mortar 139 is mixed and applied below lip 126 and below shower base 116 to support waste fitting 101 (refer FIG. 17). Further solid packing may be used below lip 126 to avoid movement between lip 126 and floor 137 whilst the mortar 139 is soft, but is not illustrated here.

Adaptor 114*a* is placed on outlet pipe 132 and height gauge 36*a* used to check that adaptor 114*a* will sit level 1. Adaptor 114*a* is then primed with PVC priming fluid and glued (not shown) into outlet pipe 132; any suitable glue and primer may be used, or the primer or glue may be omitted. If adaptor 14*c* as described for the first embodiment is used the glue sits in the bonding groove 34 to assist bonding. If adaptor 14*b* as described for the first preferred embodiment is used the high side of collar 30*b* is 2 millimetres below the top edge of lip 126 and the low side of collar 30*b* points to the centre of recess 122. During installation using adapter 14*b* the screwing pressure between lip 126 and waste pan 112 contorts the fall in waste pan 112 until finally installed with a further downward fall created to the low side of collar 30*b*. The downward fall of the waste pan 112 after installation using 14*b* is preferably about 5 degrees where it fastens to adaptor 14*b*. Installation of standard adaptor 114*a* is as described above but one side is the same level as the other, can be installed in any orientation and does not lead to a fall across waste pan 112.

Waste pan 112 is dropped or otherwise put into recess 122 over adaptor 114*a* and outlet pipe 132. Waste pan 112 as illustrated is a square of clear plastic. Waste pan 112 could, instead, have a floor with walls and a different shaped floor or any suitable pan shape for receipt of waste. Once waste pan 112 is in position, adaptor 114*a* leading to outlet pipe 132 can be seen through clear waste pan 112. The ability to be able to make visual inspection through and below waste pan 112 is an important part of the invention. Although in the described embodiment a clear plastic waste pan 112 is used to allow visual inspection of the components below, other methods of allowing visual inspection might include a waste pan having one or more transparent parts. A cover may be included to cover all or some of the transparent parts of the waste pan or the waste pan as a whole (excepting to allow waste to exit) for use after installation has occurred. Waste pan 112 could optionally include a shaped, bevelled or angled edge of 30 degrees from the horizontal to facilitate removal during installation and to assist and strengthen the bonding to lip 126.

With waste pan 112 in place collar 130*a* can be seen through the clear plastic. In this way the positions for forming holes (not labelled) in collar 130*a* and corresponding holes 140 (not labelled) for screws 142 in waste pan 112 can be readily determined, a significant advantage over existing methods. Screws 142 are stainless steel screws but any suitable alternative material or other fixing may be used. Three pilot holes (not shown) of 2.5 millimetres in diameter are drilled in situ through waste pan 112 and collar 130*a* in a single operation. A fourth pilot hole (not shown) is also drilled aligned to the outlet pipe 132, corresponding with aperture 144*a* in collar 130*a* of adaptor 114*a*. Each of the four pilot holes in waste pan 112 is a simple drill hole which can be easily and readily formed while the waste pan 112 is in situ, in recess 122 resting on lip 126 such that the positions of collar 130*a* and aperture 144*a* can be easily seen so as to determine where on waste pan 112 the holes should be drilled. Waste pan 112 is then removed by being hooked out of recess 122 such as by use of a piece of bent wire or a screw (not shown). Holes 146 formed in collar 130*a* are widened to an appropriate width. The three holes 140 for screws 142 in waste pan 112 are formed by enlarging three of the pilot holes to a size suitable to accommodate screws 142. The fourth pilot hole (not shown) is enlarged to a width of 38 millimetres to form aperture 148, ultimately for receipt of the flow of waste. Other suitable widths may be used depending on the width of outlet pipe 132. Four further holes 147 (refer FIG. 21) are included one each in the corners of waste pan 112 and used with screws to further attach waste pan 112 to lip 126 of shower base 116. PVC priming fluid (not shown) and silicone 150 (or other suitable glue or sealant) is applied to the upper surface of collar 130*a*, and to lip 126. Waste pan 112 is then replaced in recess 122 on lips 126 and holes 140 in waste pan 112 aligned with holes 142 in collar 130*a* of adaptor 114*a* below. Screws 142 are put through the aligned holes 142 and 140 and screws 142 tightened to attach through holes 140 in waste pan 112 and corresponding holes 142 in collar 130*a*. In this way waste pan 112 is attached to collar 130*a* which in turn is attached to outlet pipe 132.

Figure 21:
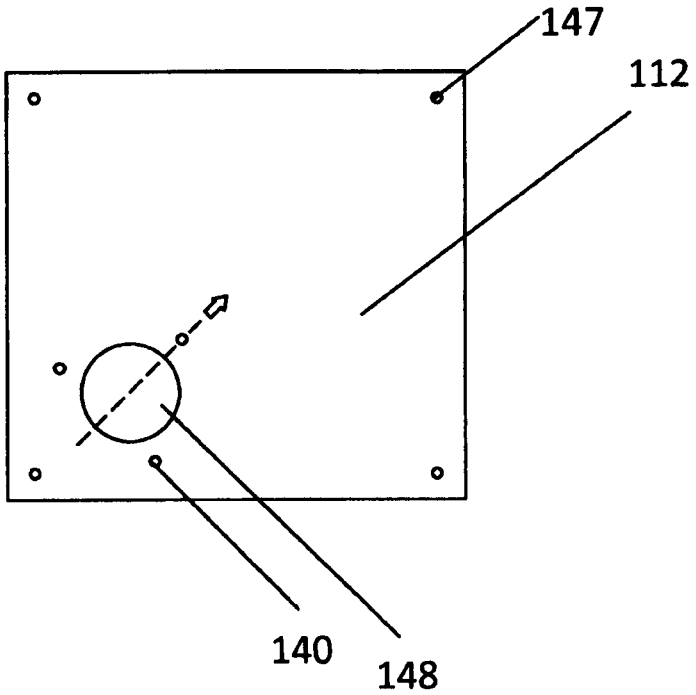
FIG. 21 is a plan view from above of a waste pan of the waste fitting of FIG. 17 after the holes and aperture have been formed for use with the adaptor of FIGS. 6 and 7 including an indication of the direction of fall.
Figure 22:
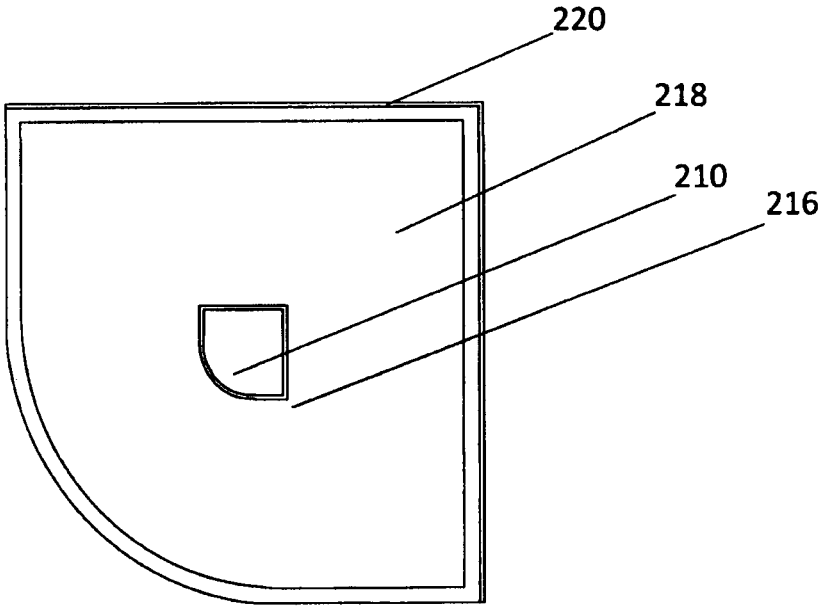
FIG. 22 is a plan view of an alternative form of the invention having a square waste curved on two sides installed in a shower base.

If adaptor 14*b* is used instead the fall of collar 30*b* applies to waste pan 112 so there is a fall of approximately 2 millimetres to the high side of adaptor 14*b* then a further fall of approximately 5 degrees from the high side to the low side of adaptor 14*b*. In FIG. 21 the direction of the downward fall that would be created in waste pan 112 by use of adaptor 14*b* in waste fitting 101 is indicated by an arrow.

Since waste pan 112 is clear, the quality of the silicone seal can be inspected, while cleaning up any excess silicone 150. Ascetic cure silicone is used in the illustrated embodiment but any suitable silicone or other sealant may be used. Finally, waste cap 110 can be positioned into recess 122 of shower base 116 to cover waste pan 112 and all that can be seen below. Waste cap 110 has lugs 152 which maintain waste cap 110 an even distance from wall 124 of recess 122 so there is a small gap all the way around. Waste cap 110 also includes lifting grooves 158. Lifting groove 158 may alternatively be a single groove. Use of a small gap, rather than a grill discourages mosquitoes and other insects that may enter or exit through traditional waste fittings. Plugs (not shown) may be used to maintain a gap between wall 124 or recess 122 and waste cap 110 to allow free flow of water and waste.

In use, waste flows towards recess 122, due to the fall in floor 118 of shower base 116, and into waste fitting 101 by means of the small gap around waste cap 110. Waste cap 110 includes a number of cut-outs 154 through which waste flows onto waste pan 112. Cut-outs 156 are illustrated as rectangular cut-outs but may be any suitable shape. The fall of waste pan 112 directs the flow of waste through aperture 148 in waste pan 112, aperture 144*a* in adaptor 114*a* (or 44*b* in adaptor 14*b* or 44*c* in adaptor 14*c* as appropriate) and ultimately down outlet pipe 132.

Waste cap 110 can be readily removed to allow inspection through waste pan 112 to check the installation or for cleaning of waste pan 112. Removal of waste cap 110 can be achieved by use of a household spoon or similar (not shown). The tip of the spoon is passed into recess 122 between wall 124 and waste cap 110 and into lifting slots 158. There are four lifting slots 158 illustrated but these may be replaced by any number of suitable slots or a single groove.

Figure 23:
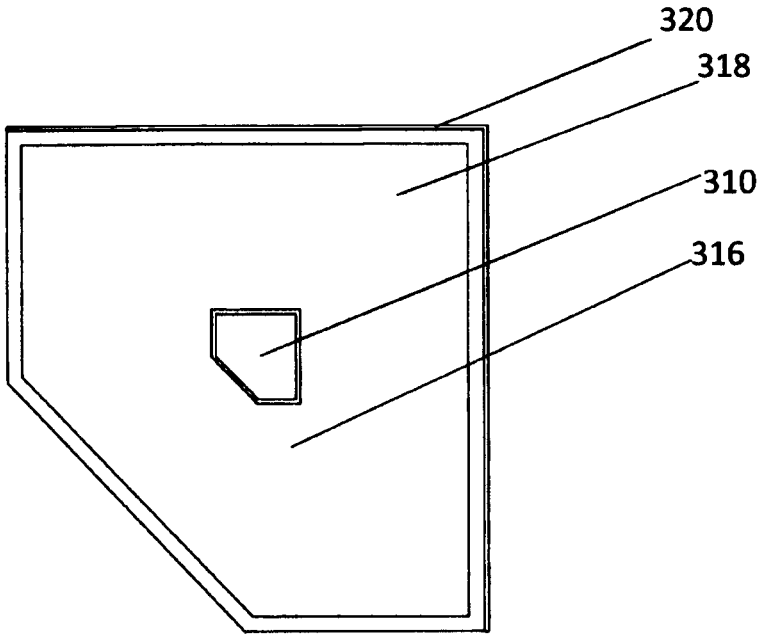
FIG. 23 is a plan view of an alternative form of the invention having a square waste with a corner cut, installed in a shower base.

FIG. 23 illustrate a third preferred embodiment of the invention. FIG. 23 shows an alternative shape of waste fitting 201 having a generally square shape, curved on two sides. Waste fitting 201 is fitted in the same way and with the same parts and method of installation as the first and second preferred embodiments.

FIG. 24 illustrate a fourth preferred embodiment of the invention. FIG. 24 shows an alternative shape of waste fitting 301 having a generally square shape, with a corner removed. Waste fitting 301 is fitted in the same way and with the same parts and method of installation as the first and second preferred embodiments.

Use of the described waste fitting in any of the four described embodiments and with use of any of the three adaptors is advantageous in many ways. For example, the outlet pipe 32, 132 can be connected closely to the waste fitting 1, 101, 201 or 301 so waste can flow straight down and away from the shower base 16, 116. The clear waste pan 112 enables alignment with the outlet pipe 32, 132 below, assisted by the width of the waste giving far greater scope for positioning of aperture 48, 148. It is highly desirable to plumb a waste fitting to the pipes below as directly as possible to avoid the need to use plumbdingers to breach the gap. To try to do so requires careful measuring and marking and even then the alignment may not be perfect. When fitting the described waste fitting 1, 101, 201 or 301 the installation can be made from above the shower base as all the alignment can be made by visually inspecting the plumbing below through the clear waste pan 12, 112 and making holes accordingly. There should be no need to fit parts from the bottom of the shower or the like as the whole process can be complete from above and no plumbdinger or other device should be required, a significant advance. The waste fitting 1, 101, 201 or 301 can be used with existing pipes and components and does not require any additional tools or techniques to be used by the plumber when installing. Hence plumbing a shower, bath, spa or the like using the new waste fitting 1, 101, 201 or 301 is quicker, easier and produces a better job in the end than existing waste fittings. Saving time and parts for the plumber will also save the customer time and money.

It will be apparent to a person skilled in the art that changes may be made to the embodiments disclosed herein without departing from the spirit and scope of the invention in its various aspects.

What is claimed is:

1. A waste fitting for a waste outlet, the waste fitting comprising:

a waste outlet having a terminal end, the terminal end including an opening;

a waste pan into which waste can flow, the waste pan positioned above the terminal end of the waste outlet and including at least one transparent part allowing visual inspection therethrough, wherein, during installation, the opening of the waste outlet can be located by visual inspection through the waste pan, enabling a suitable position to be determined for forming and or positioning of at least one aperture in the waste pan such that, in use, waste that flows into the waste pan can exit through the at least one aperture towards the opening in the waste outlet.

2. The waste fitting of claim 1, wherein the waste fitting is part of a shower base, bath, or spa adapted to receive the waste pan.

3. The waste fitting of claim 1, wherein the whole waste pan allows visual inspection therethrough.

4. The waste fitting of claim 1, wherein the suitable positioning of the at least one aperture is substantially aligned with the opening of the waste outlet.

5. The waste fitting of claim 4, wherein the position of the at least one aperture is substantially directly above the opening of the waste outlet, such that waste will fall directly into the waste outlet.

6. The waste fitting of claim 1, wherein during installation the waste pan is connected to the waste outlet.

7. The waste fitting of claim 1, wherein an adaptor is included between the waste pan and the waste outlet.

8. The waste fitting of claim 7, wherein the adaptor is attached to the waste outlet before being attached to the waste pan.

9. The waste fitting of claim 1, wherein the at least one aperture is formed in the waste pan after visual inspection therethrough of the position of the opening of the waste outlet enabling the substantial alignment of the at least one aperture and the opening in the waste outlet whereby once the waste pan and the waste outlet are connected waste that flows into the waste pan can flow into the waste outlet.

10. The waste fitting of claim 1, wherein the waste fitting is installed in a shower base and no access need be made below the shower base when installing the waste fitting once the shower base is in place as visual inspection of the position of the waste outlet can be made through the waste fitting.

11. The waste fitting of claim 1, wherein the waste pan is positioned substantially parallel to the terminal end of the waste outlet.

* * * * *